US009021671B2

(12) United States Patent
Kapelski

(10) Patent No.: US 9,021,671 B2
(45) Date of Patent: May 5, 2015

(54) SLOT GRIPPER

(75) Inventor: Rainer Kapelski, Boel (DE)

(73) Assignee: KALP GmbH, Boel (DE)

( * ) Notice: Subject to any disclaimer, the term of this patent is extended or adjusted under 35 U.S.C. 154(b) by 463 days.

(21) Appl. No.: 13/577,478

(22) PCT Filed: Jan. 14, 2011

(86) PCT No.: PCT/DE2011/000028

§ 371 (c)(1),
(2), (4) Date: Aug. 7, 2012

(87) PCT Pub. No.: WO2011/098061

PCT Pub. Date: Aug. 18, 2011

(65) Prior Publication Data

US 2012/0304598 A1 Dec. 6, 2012

(30) Foreign Application Priority Data

Feb. 10, 2010 (DE) ..... 10 2010 007 675

(51) Int. Cl.
*B23P 19/04* (2006.01)
*B63B 25/00* (2006.01)
*B65D 90/00* (2006.01)

(52) U.S. Cl.
CPC ..... *B65D 90/002* (2013.01)

(58) Field of Classification Search
CPC ..... B65D 90/0013; B65D 90/002; B65D 90/125; B65D 88/129; B65D 90/0026; B65D 2590/0016; B60P 7/132; B63B 25/28; B63B 25/004; B61D 45/007; B65G 63/004; F16B 21/02
USPC ..... 29/244, 809; 53/287, 476; 137/343; 414/139.4; 410/96, 101, 77, 82, 83, 85
See application file for complete search history.

(56) References Cited

U.S. PATENT DOCUMENTS 3,481,298 A * 12/1969 Dluhy ..... 114/72
3,776,169 A * 12/1973 Strecker ..... 410/77
3,973,684 A * 8/1976 Di Martino ..... 206/512
4,457,650 A * 7/1984 Tseng ..... 410/111
4,546,945 A * 10/1985 Nessfield ..... 248/346.03
4,591,307 A * 5/1986 Clive-Smith ..... 410/83

(Continued)

FOREIGN PATENT DOCUMENTS

DE 102006015807 9/2007
WO WO 2006/024071 3/2006

(Continued)

*Primary Examiner* — Lee D Wilson
*Assistant Examiner* — Jamal Daniel
(74) *Attorney, Agent, or Firm* — Diederiks & Whitelaw, PLC

(57) ABSTRACT

A slot gripper for removing twistlocks from container fittings or for inserting twistlocks into container fittings, comprising a twistlock receptacle, arranged in a receptacle plate and a tool that locks and unlocks twistlocks arranged in the twistlock receptacle by rotating, is characterized by two clamping jaws extending in the receptacle parallel to the receptacle plate and arranged opposite each other. A first pin extends from the receptacle plate at a right angle at the edge of the receptacle, a second pin is arranged on side of the first pin opposite the receptacle and extends from the receptacle plate at a right angle, and a rope guiding element extends from the receptacle plate at a right angle at the edge of the receptacle. The first pin, the second pin, and the rope guiding element are each supported against the force of a spring and can be lowered in the receptacle plate.

8 Claims, 3 Drawing Sheets

(56) References Cited

U.S. PATENT DOCUMENTS

| | | | | |
|---|---|---|---|---|
| 5,193,253 | A * | 3/1993 | Janke et al. | 24/287 |
| 7,341,422 | B1 * | 3/2008 | McCown et al. | 414/803 |
| 2005/0260054 | A1 * | 11/2005 | Bederke | 410/31 |
| 2006/0115350 | A1 * | 6/2006 | Weis | 414/139.4 |
| 2006/0280573 | A1 * | 12/2006 | Hsieh | 410/85 |
| 2008/0210687 | A1 * | 9/2008 | Clive-Smith | 220/1.5 |
| 2008/0286074 | A1 * | 11/2008 | Chellappa et al. | 414/140.3 |
| 2011/0265318 | A1 * | 11/2011 | Kapelski | 29/809 |
| 2014/0359977 | A1 * | 12/2014 | Bean | 24/287 |

FOREIGN PATENT DOCUMENTS

| | | |
|---|---|---|
| WO | WO 2007/098749 | 9/2007 |
| WO | WO 2008/095605 | 8/2008 |
| WO | WO 2010/097679 | 9/2010 |

* cited by examiner

SLOT GRIPPER

CROSS-REFERENCE TO RELATED APPLICATIONS

This application represents a National Stage application of PCT/DE2011/000028 entitled "Slot Gripper" filed Jan. 14, 2011, pending.

BACKGROUND OF THE INVENTION

The invention relates to a slot gripper for removing twistlocks from container fittings or for inserting twistlocks in container fittings, comprising a twistlock receptacle arranged in a receptacle plate and a tool that locks and unlocks the twistlocks arranged in the twistlock receptacle by rotating.

Several devices, in particular lashing platforms, have already been proposed for automatically removing twistlocks from container fittings or for inserting twistlocks in container fittings, that automate and carry out in a shorter time this task that is otherwise carried out accompanied by high safety requirements; see for example WO 2010/097679 A1. A lashing platform that is of particularly favourable design and works independently in terms of energy is known for example from WO 2007/098749 A1.

For inserting and removing the twistlocks, there are arranged at predetermined positions of the lashing platform that coincide with the positions of the container fittings of a container set down on the lashing platform, slot grippers that receive the twistlocks, unlock them by rotating and transfer them to a magazine, or insert twistlocks removed from the magazine into the container fittings and lock them there by rotating.

However, these automatically operating lashing platforms are problematic in that there are different twistlock types with different twistlock geometry and function that can be unlocked and locked using only specially adapted tools. A lashing platform, after having been installed, can in principle only handle one container that exhibits a certain twistlock type.

For this reason, there was already created an automatic lashing platform by RAM Spreaders Ltd (UK), known from obvious pre-use as Pinsmart, where receptacle plates that can be exchanged manually are provided for the slot grippers and that each exhibit a different geometry adapted to a twistlock type.

However, this solution has a disadvantage in that adaptation of the lashing platform to different twistlock types must take place manually, as a result of which personnel has to be brought into the danger zone of the lashing platform (or other device for inserting twistlocks in containers and/or removing them therefrom). Furthermore the exchange procedure is labour intensive and time-consuming and is a source of errors that can lead to the lashing platform (or other device), in particular the slot gripper, being damaged by inserting a wrong receptacle plate. Over and above this, the exchange plates always have to be kept available in a sufficient functional number.

SUMMARY OF THE INVENTION

The object of the invention is therefore to create a slot gripper that can lock and unlock different twistlock types using simple means. The object of the invention is in particular to create a slot gripper for different twistlock types that can be operated without a complex mechanical and electronic control system and is therefore as reliable as possible and largely maintenance free in handling operations.

BRIEF DESCRIPTION OF THE DRAWINGS

The invention is described in more detail using an exemplary embodiment of particularly preferred design, in which.

DETAILED DESCRIPTION OF THE INVENTION

Figure 1:
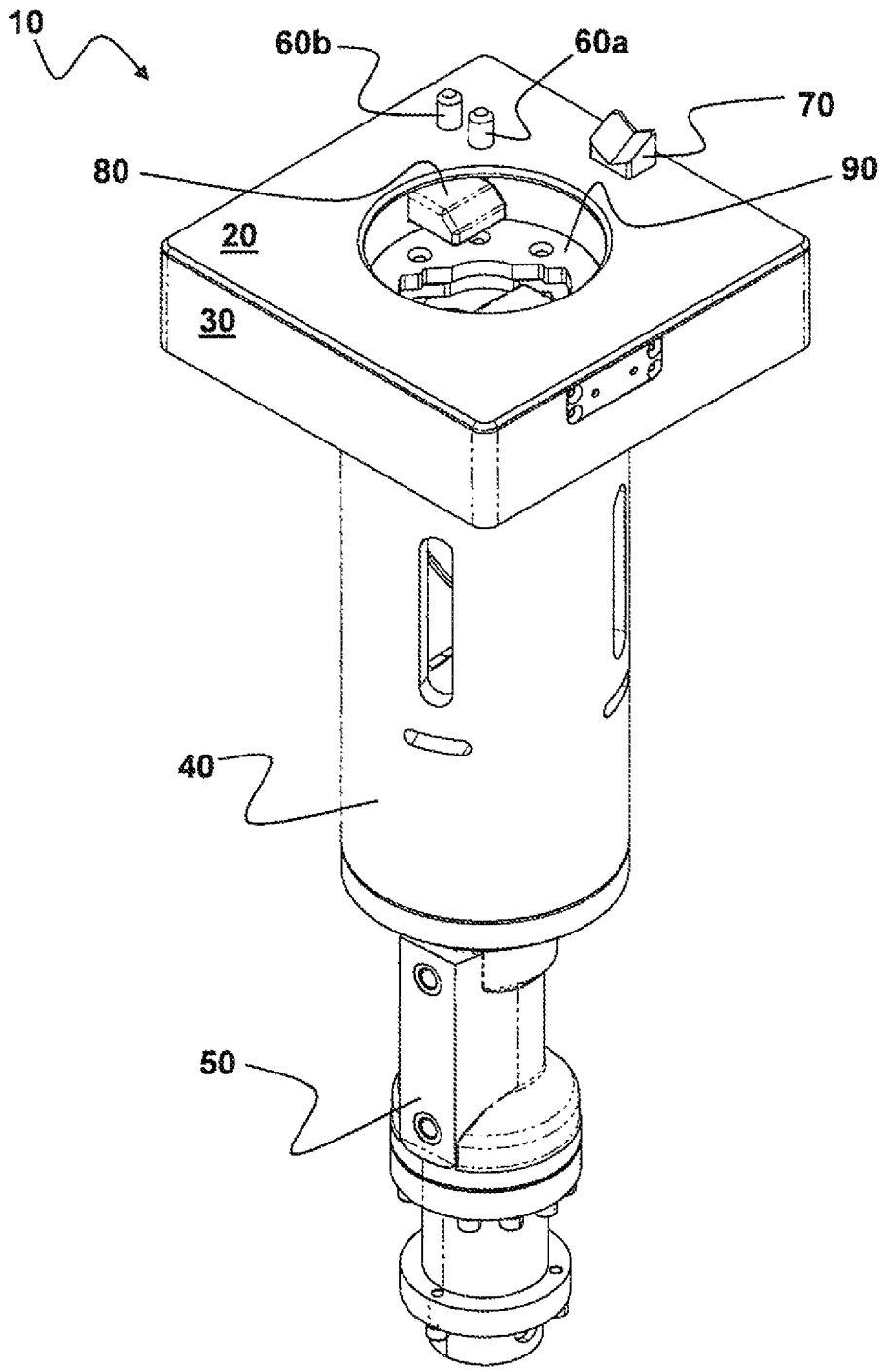
FIG. 1 shows a perspective view of a slot gripper according to the exemplary embodiment of particularly preferred design.

FIG. 1 shows a slot gripper of particularly preferred design having the inventive features. The slot gripper 10 comprises a receptacle plate 13 exhibiting a receptacle for twistlocks. The receptacle plate 30 is connected to a cylinder 40 arranged below it that supports, preferably in a sprung fashion, the tool 90 for locking and unlocking twistlocks, arranged in the receptacle plate 30 or in the cylinder 40, the tool 90 being driven by a motor 50 arranged below the cylinder 40 that is preferably designed as a hydraulic rotary actuator.

Above the receptacle plate 30, there is preferably placed a wear plate 20 that protects the mechanical components of the slot gripper 10. The wear plate 20 exhibits essentially the same openings as the receptacle plate 30. Thus, an opening that is preferably arranged centrally is provided in the wear plate 20 and enables access to the twistlock receptacle provided in the receptacle plate 30 for receiving twistlocks. Here, the opening provided in the wear plate 20 can have a somewhat smaller opening for protecting the components arranged in the receptacle plate 30. Over and above this, the wear plate 20 exhibits openings that are penetrated by the first and second pins 60*a*, 60*b* that extend perpendicular from the receptacle plate 30 and the rope guide 70 that likewise extends perpendicular vertically from the receptacle plate 30.

The first pin 60*a* and the second pin 60*b* are arranged adjacent to the receptacle or the corresponding opening in the wear plate 20 and sprung-mounted in the receptacle plate 30 so that—depending on the twistlock type—either both pins 60*a*, 60*b* or only pin 60*a* can be pressed down and countersunk completely in the receptacle plate 30 or until the pins 60*a*, 60*b* are flush with the wear plate 20.

The rope guide 70 next to the receptacle is also supported in a sprung manner in the receptacle plates 30 and can be pressed in the case of non-use into the receptacle plate 30 by lowering a twistlock on to the rope guide, so that the twistlock can achieve its optimum orientation for inserting or removing by rotating the tool 90 and using one of the pins 60*a*, 60*b* or the clamping jaws 80 as abutment.

In case the rope guide 70 is required, it tilts the traction rope of the twistlock slightly upwards so that the locking or unlocking process can be carried out without any problems.

Figure 2:
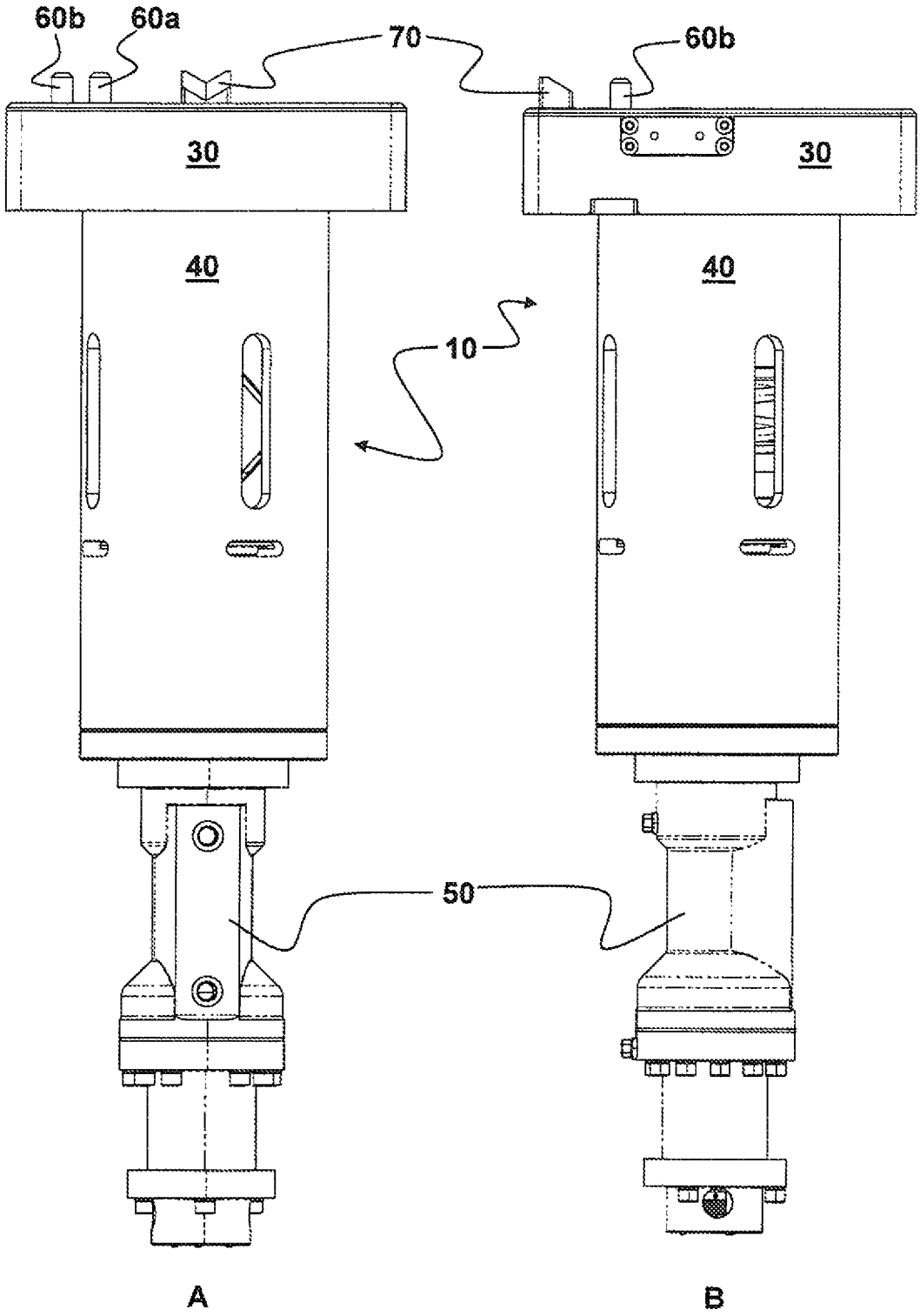
FIG. 2 shows two side views of the slot gripper of FIG. 1.

FIG. 2 shows the slot gripper 10 from FIG. 1 in two side views, side view B showing the slot gripper 10 rotated counterclockwise by 90 relative to the side view A.

Figure 3:
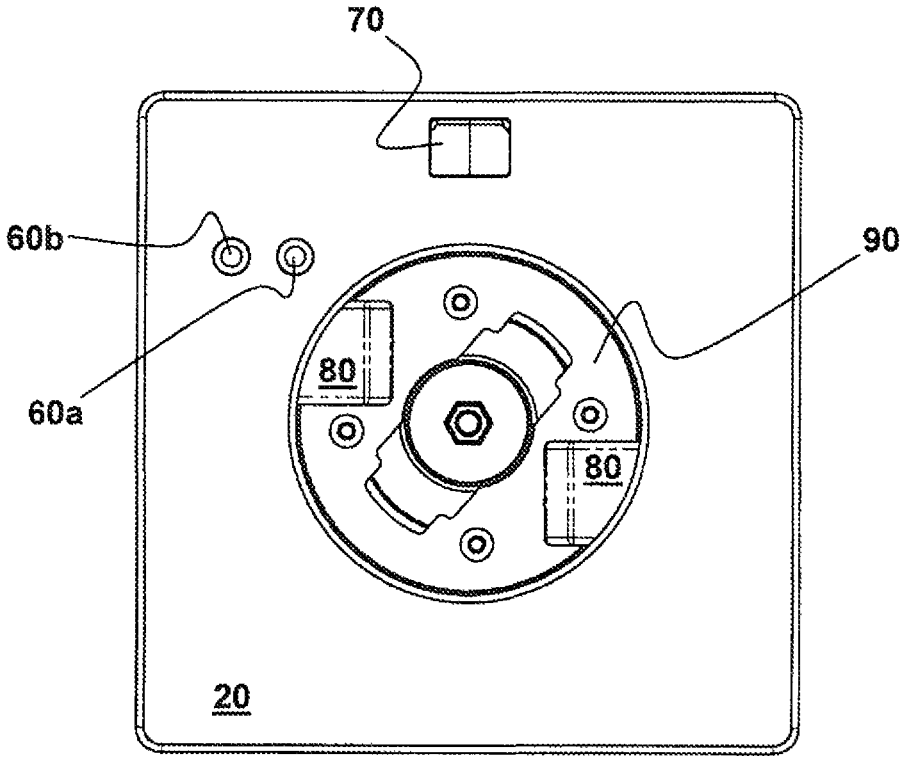
FIG. 3 shows a top view of the exemplary embodiment of the inventive slot gripper of particularly preferred design.

FIG. 3 finally shows the slot gripper 10 in a top view. The tool 90, arranged in the receptacle 30, for rotating the twistlock, and the clamping jaws 80 can be seen clearly that serve as abutments during the rotary movement of some twistlocks and fix them in their position.

The clamping jaws 80 that are preferably sprung-mounted, exhibit, in a particularly preferred manner, locking means, using which the clamping jaws 80 can be locked in their position. This can take place on the one hand manually by laterally pressing the clamping jaws 80 into the receptacle plate 30 or controlled automatically by moving the clamping jaws 80 into the receptacle plate 30. It is essential that the clamping jaws 80 release the receptacle for certain twistlock types almost completely so as to guarantee a smooth process.

The function of the abutment that prevents the entire twistlock from co-rotating is assumed, when the clamping jaws 90 are pressed in or moved in, by the first pin 60*a* or the second pin 60*b* that project from the plane of the receptacle 30 or of the wear plate 20. Here it can be seen clearly that the first and the seconds pin 60*a*, 60*b* lie on a tangent imagined relative to the twistlock receptacle that is preferably of circular design. This ensures that different twistlocks have the same orientation and can experience the same handling as a result of the same structural components by a lashing platform that preferably also exhibits a magazine for provisioning and storing twistlocks.

The longitudinal axis of the rope guide 70 is arranged parallel to the imaginary tangent and is designed for guiding the twistlock rope perpendicular to the imaginary tangent, the rope being pressed slightly upwards by the rope guide.

Some twistlock types are presented as examples that can be handled automatically using the slot gripper according to the invention:

1. Space twistlocks with a bolt on one side are inserted into the slot of the slot gripper tool 90, only the tools 90 being rotated for unlocking or locking the space twistlock without requiring an abutment formed on the slot gripper e.g. the clamping jaws 80, or the pins 60*a*, 60*b*.
2. In the case of space twistlocks with a bolt on both sides, the lower bolt is inserted into the tool 90 and locked or unlocked by rotating the tool 90, the clamping jaws 80 resting on the body of this space twistlock serving as an abutment.
3. Deck twistlocks exist in different designs, e.g. with one traction rope (a) or with two traction ropes (b):
   a. Deck twistlocks with one traction rope exhibits a sprung rope that can latch in accordance with the desired orientation of the upper and lower bolt. The rope of this type of deck twistlock lies in the rope guiding element 70 that supports the disengagement of the rope during the twist procedure of the lower bolt by the tool 90. In the process, the clamping jaws 80 serve as abutment for the body of this twistlock type.
   b. In the case of deck twistlocks with two traction ropes, the traction ropes come to lie on both sides next to the guide rope element 70 and therefore do not experience any support by the rope guiding element 70. In contrast to deck twistlocks with only one traction rope, no latching of the traction ropes is envisaged, pulling on one of the ropes resulting in a twisting of the lower bolt in the one or the other direction. The body of this type of Dick twistlocks was to traction ropes is dimensioned such that it does not project into the receptacle but comes to lie on the receptacle plate 30 or the wear plate 20. Therefore the clamping jaws 80 are without any function, and that pin 60*a* closer to the receptacle acts as abutment for the body of this twistlock during the twisting process of the tool 90 receiving the bolt of the twistlock.

Here it is advantageous if the clamping jaws 80 do not project into the receptacle. For this purpose, the clamping jaws 80 can be moved or pressed in automatically or manually into the receptacle plate 30 and locked there during the twisting process.

4. Even deck twistlocks that exhibits a traction rod instead of a traction rope can be handled. This type of deck twistlock exhibits a very large body that rests both on the rope guiding element 70 and on the first pin 60*a* and presses these elements into the receptacle plate 30 and only on the second pin 60 serves as an abutment for the rotary movement caused by the tool receiving the bolt, without the clamping jaws 80 performing (being able to perform) a function as abutment.

Here, too, it is an, advantage if the camping jaws 80 do not project into the receptacle. As already mentioned, the clamping jaws 80 can be moved or pressed automatically or manually into the receptacle plate 30 and locked there during the twisting process.

The slot gripper is preferably designed as a structural unit of a lashing platform, but can, however, also be used in any other device for inserting and removing twistlocks. To this end, the slips the slot gripper 10 is designed such that it can be moved in particular vertically.

To avoid a manual adjustment of the clamping jaws 80, preferably a control system can be provided that moves the clamping jaws 80 in their position into the receptacle and out of it and locks them. For this purpose, particularly preferably a sensor can be provided that detects the twistlock type and moves and locks the clamping jaws 80 automatically.

The invention claimed is:

1. A slot gripper for removing twist-locks from container fittings or for inserting twistlocks into container fittings, comprising a twistlock receptacle arranged in a receptacle plate and a tool that locks and unlocks twistlocks arranged in the twistlock receptacle by rotating, characterized by two clamping jaws that extend in the receptacle parallel to the receptacle plate and that are arranged opposite each other, a first pin extending from the receptacle plate at a right angle at the edge of the receptacle, a second pin, which is arranged on that side of the first pin opposite the receptacle and which extends from the receptacle plate at a right angle, and a rope guiding element extending from the receptacle plate at a right angle at the edge of the receptacle, the first pin, the second pin, and the rope guiding element being each supported against the force of a spring and being able to be lowered in the receptacle plate.

2. The slot gripper according to claim 1, characterised in that the clamping jaws are spring mounted.

3. The slot gripper according to claim 1, characterised by locking means that lock the clamping jaws in their position.

4. The slot gripper according to claim 1, characterised in that the receptacle exhibits a circular design and the first and the second pins are arranged on an imaginary tangent.

5. The slot gripper according to claim 4, characterised in that the rope guiding element is arranged parallel to the imaginary tangents and is designed to guide the twistlock rope perpendicular to the imaginary tangent.

6. The slot gripper according to claim 1, characterised in that on the receptacle plate a wear plate is arranged that exhibits openings for the first and the second pins, the rope guiding element and for inserting twistlocks into the twistlock receptacle provided in the receptacle plate, the first and the second pins and the rope guiding element projecting beyond the wear plate.

7. The slot gripper according to claim 1, characterised in that the slot gripper is designed such that it can be moved vertically.

8. The slot gripper according to claim 1, characterised by at least one sensor for detecting the twistlock type and a control system connected to the at least one sensor for moving the clamping jaws.

* * * * *